US007905774B2

(12) United States Patent
Walker et al.

(10) Patent No.: US 7,905,774 B2
(45) Date of Patent: Mar. 15, 2011

(54) APPARATUS PROVIDING PAYOUTS PROPORTIONAL TO WAGERS AND METHODS FOR OPERATING SAME

(75) Inventors: Jay S. Walker, Ridgefield, CT (US); James A. Jorasch, Stamford, CT (US)

(73) Assignee: IGT, Reno, NV (US)

( * ) Notice: Subject to any disclaimer, the term of this patent is extended or adjusted under 35 U.S.C. 154(b) by 1140 days.

(21) Appl. No.: 10/459,678

(22) Filed: Jun. 11, 2003

(65) Prior Publication Data

US 2003/0216170 A1 Nov. 20, 2003

Related U.S. Application Data

(63) Continuation-in-part of application No. 09/782,998, filed on Feb. 14, 2001, now Pat. No. 6,589,115, which is a continuation of application No. 08/947,243, filed on Oct. 8, 1997, now Pat. No. 6,213,877.

(51) Int. Cl.
*A63F 9/24* (2006.01)

(52) U.S. Cl. ..... 463/25; 463/16; 463/20; 463/26; 463/27

(58) Field of Classification Search ..... 463/16–23, 463/25–31, 46
See application file for complete search history.

(56) References Cited

U.S. PATENT DOCUMENTS

| | | | | |
|---|---|---|---|---|
| 3,269,503 | A | 8/1966 | Foster | 194/1 |
| 3,439,281 | A | 4/1969 | McGuire et al. | 328/153 |
| 3,642,287 | A | 2/1972 | Lally et al. | 273/143 R |
| 3,648,290 | A | 3/1972 | Hartigan | 273/143 C |
| 3,834,712 | A | 9/1974 | Cox | 273/143 R |
| 3,841,456 | A | 10/1974 | Levasseur | 194/1 N |
| 4,095,795 | A | 6/1978 | Saxton et al. | 273/143 R |
| 4,448,419 | A | 5/1984 | Telnaes | 273/143 R |
| 4,508,345 | A | 4/1985 | Okada | 273/143 R |
| 4,652,998 | A | 3/1987 | Koza et al. | 364/412 |
| 4,669,731 | A | 6/1987 | Clarke | 273/143 R |
| 4,856,787 | A | 8/1989 | Itkis | 273/237 |
| 4,958,835 | A | 9/1990 | Tashiro et al. | 273/85 G |
| 5,042,818 | A | 8/1991 | Weingardt | 273/292 |
| 5,102,134 | A | 4/1992 | Smyth | 273/138 A |
| 5,123,649 | A | 6/1992 | Tiberio | 273/143 R |
| 5,170,345 | A | 12/1992 | Poole | 364/410 |
| 5,178,390 | A | 1/1993 | Okada | 273/143 R |
| 5,251,897 | A | 10/1993 | Fulton | 273/85 CP |
| 5,277,424 | A | 1/1994 | Wilms | |
| 5,282,620 | A | 2/1994 | Keesee | 273/138 A |
| 5,286,023 | A | 2/1994 | Wood | 273/138 A |
| 5,294,120 | A | 3/1994 | Schultz | 273/85 CP |
| 5,401,023 | A | 3/1995 | Wood | 273/85 CP |

(Continued)

OTHER PUBLICATIONS

Office Action for U.S. Appl. No. 08/947,246 dated Sep. 24, 1999, 5 pp.

(Continued)

*Primary Examiner* — Melba Bumgarner
*Assistant Examiner* — Tramar Harper
(74) *Attorney, Agent, or Firm* — K&L Gates LLP

(57) ABSTRACT

A gaming device such as a slot machine is provided having a payout proportional to a wager value. In accordance with one or more embodiments, the gaming machine provides a player with the ability to flexibly and automatically increase and decrease wagers, thereby allowing the player to press his bets when he feels lucky, and to decrease his bets when he feels unlucky. Different proportional payout tables are provided for different levels of wagers.

5 Claims, 12 Drawing Sheets

U.S. PATENT DOCUMENTS

| | | | | | |
|---|---|---|---|---|---|
| 5,401,024 | A | | 3/1995 | Simunek | 273/138 A |
| 5,456,465 | A | | 10/1995 | Durham | 273/138 A |
| 5,494,287 | A | | 2/1996 | Manz | 273/143 R |
| 5,511,781 | A | | 4/1996 | Wood et al. | 273/85 CP |
| 5,511,784 | A | | 4/1996 | Furry et al. | 273/143 R |
| 5,513,851 | A | | 5/1996 | Harris | 273/274 |
| 5,524,888 | A | | 6/1996 | Heidel | 463/22 |
| 5,531,441 | A | | 7/1996 | Dabrowski et al. | 463/12 |
| 5,766,075 | A | | 6/1998 | Cook et al. | 463/25 |
| 5,833,537 | A | * | 11/1998 | Barrie | 463/21 |
| 5,848,932 | A | * | 12/1998 | Adams | 463/20 |
| 5,851,010 | A | | 12/1998 | Feinberg | 273/274 |
| 5,851,147 | A | | 12/1998 | Stupak et al. | 463/13 |
| 5,879,234 | A | | 3/1999 | Mengual | 463/20 |
| 5,911,418 | A | * | 6/1999 | Adams | 273/274 |
| 5,934,672 | A | | 8/1999 | Sines et al. | 273/143 R |
| 5,938,196 | A | | 8/1999 | Antoja | 273/143 C |
| 5,947,821 | A | * | 9/1999 | Stone | 463/13 |
| 5,967,896 | A | * | 10/1999 | Jorasch et al. | 463/25 |
| 5,971,850 | A | | 10/1999 | Liverance | 463/23 |
| 6,113,492 | A | | 9/2000 | Walker et al. | 463/16 |
| 6,113,493 | A | | 9/2000 | Walker et al. | 463/25 |
| 6,123,333 | A | | 9/2000 | McGinnis, Sr. et al. | 273/146 |
| 6,213,877 | B1 | | 4/2001 | Walker et al. | 463/26 |
| 6,334,814 | B1 | * | 1/2002 | Adams | 463/20 |
| 6,780,104 | B2 | * | 8/2004 | Fox | 463/13 |
| 6,890,258 | B2 | * | 5/2005 | Weiss | 463/25 |
| 2003/0190944 | A1 | * | 10/2003 | Manfredi et al. | 463/20 |

OTHER PUBLICATIONS

Office Action for U.S. Appl. No. 08/947,243 dated May 8, 2000, 6pp.
Notice of Allowability for U.S. Appl. No. 08/947,243 dated Nov. 2, 2000, 4pp.
Office Action for U.S. Appl. 09/782,998 dated Jul. 12, 2001, 6pp.
Office Action for U.S. Appl. No. 09/782,998 dated Mar. 1, 2002, 6pp.
Office Action for U.S. Appl. No. 09/782,998 dated Aug. 27, 2002, 7pp.
Notice of Allowability for U.S. Appl. No. 09/782998 dated Feb. 10, 2002, 3pp.

* cited by examiner

126

| | RANDOM NUMBER 130 | COMBINATION 132 | EXPECTED HITS PER CYCLE 134 |
|---|---|---|---|
| 128a | 1-8570 | NONWINNING COMBINATION | 8570 |
| 128b | 8571-9250 | CHERRY/ANY/ANY | 680 |
| 128c | 9251-9930 | ANY/ANY/CHERRY | 680 |
| 128d | 9931-10130 | CHERRY/CHERRY/ANY | 200 |
| 128e | 10131-10330 | ANY/CHERRY/CHERRY | 200 |
| 128f | 10331-10398 | CHERRY/ANY/CHERRY | 68 |
| 128g | 10399-10418 | CHERRY/CHERRY/CHERRY | 20 |
| 128h | 10419-10460 | BAR/ORANGE/ORANGE | 42 |
| 128i | 10461-10466 | ORANGE/ORANGE/BAR | 6 |
| 128j | 10467-10508 | ORANGE/ORANGE/ORANGE | 42 |
| 128k | 10509-10528 | BAR/PLUM/PLUM | 20 |
| 128l | 10529-10533 | PLUM/PLUM/BAR | 5 |
| 128m | 10534-10583 | PLUM/PLUM/PLUM | 50 |
| 128n | 10584-10587 | BAR/BELL/BELL | 4 |
| 128o | 10588-10607 | BELL/BELL/BAR | 20 |
| 128p | 10608-10627 | BELL/BELL/BELL | 20 |
| 128q | 10628-10647 | BAR/BAR/BAR | 20 |
| 128r | 10648 | 7/7/7 | 1 |

PRIOR ART

FIG. 2

135

| | COMBINATION 132 | EXPECTED HITS PER CYCLE 134 | PAY AMOUNT 138 | COINS PAID 140 | FIXED PLAYER WIN/ (LOSS) 142 | PROPOR-TIONAL PAYOUT MULTIPLIER 144 | PROPORTION-AL PLAYER WIN/(LOSS) 146 |
|---|---|---|---|---|---|---|---|
| 136a | NONWINNING COMBINATION | 8570 | 0 | 0 | (8,570) | 80% | (1714.0) |
| 136b | CHERRY/ANY/ANY | 680 | 2 | 1,360 | 680 | 130% | 204.0 |
| 136c | ANY/ANY/CHERRY | 680 | 2 | 1,360 | 680 | 130% | 204.0 |
| 136d | CHERRY/CHERRY/ANY | 200 | 5 | 1,000 | 800 | 160% | 120.0 |
| 136e | ANY/CHERRY/CHERRY | 200 | 5 | 1,000 | 800 | 160% | 120.0 |
| 136f | CHERRY/ANY/CHERRY | 68 | 5 | 340 | 272 | 160% | 40.8 |
| 136g | CHERRY/CHERRY/CHERRY | 20 | 20 | 400 | 380 | 300% | 40.0 |
| 136h | BAR/ORANGE/ORANGE | 42 | 10 | 420 | 378 | 175% | 31.5 |
| 136i | ORANGE/ORANGE/BAR | 6 | 10 | 60 | 54 | 175% | 4.5 |
| 136j | ORANGE/ORANGE/ORANGE | 42 | 20 | 840 | 798 | 300% | 84.0 |
| 136k | BAR/PLUM/PLUM | 20 | 14 | 280 | 260 | 175% | 15.0 |
| 136l | PLUM/PLUM/BAR | 5 | 14 | 70 | 65 | 175% | 3.75 |
| 136m | PLUM/PLUM/PLUM | 50 | 20 | 1,000 | 950 | 300% | 100.0 |
| 136n | BAR/BELL/BELL | 4 | 18 | 72 | 68 | 200% | 4.0 |
| 136o | BELL/BELL/BAR | 20 | 18 | 360 | 340 | 200% | 20.0 |
| 136p | BELL/BELL/BELL | 20 | 20 | 400 | 380 | 300% | 40.0 |
| 136q | BAR/BAR/BAR | 20 | 50 | 1,000 | 980 | 750% | 130.0 |
| 136r | 7/7/7 | 1 | 100 | 100 | 99 | 1,000% | 9.0 |

FIG. 3

129

| | COMBINATION 132 | EXPECTED HITS PER CYCLE 134 | PROPOR-TIONAL PAYOUT MULTIPLIER 144 | PROPORTION-AL PLAYER WIN/(LOSS) 146 | PROPOR-TIONAL PAYOUT MULTIPLIER 145 | PROPORTION-AL PLAYER WIN/(LOSS) 147 |
|---|---|---|---|---|---|---|
| 137a | NONWINNING COMBINATION | 8570 | 80% | (1714.0) | 80% | (1714.0) |
| 137b | CHERRY/ANY/ANY | 680 | 130% | 204.0 | 130% | 204.0 |
| 137c | ANY/ANY/CHERRY | 680 | 130% | 204.0 | 130% | 204.0 |
| 137d | CHERRY/CHERRY/ANY | 200 | 160% | 120.0 | 160% | 120.0 |
| 137e | ANY/CHERRY/CHERRY | 200 | 160% | 120.0 | 160% | 120.0 |
| 137f | CHERRY/ANY/CHERRY | 68 | 160% | 40.8 | 160% | 40.8 |
| 137g | CHERRY/CHERRY/CHERRY | 20 | 300% | 40.0 | 300% | 40.0 |
| 137h | BAR/ORANGE/ORANGE | 42 | 175% | 31.5 | 175% | 31.5 |
| 137i | ORANGE/ORANGE/BAR | 6 | 175% | 4.5 | 175% | 4.5 |
| 137j | ORANGE/ORANGE/ORANGE | 42 | 300% | 84.0 | 300% | 84.0 |
| 137k | BAR/PLUM/PLUM | 20 | 175% | 15.0 | 175% | 15.0 |
| 137l | PLUM/PLUM/BAR | 5 | 175% | 3.75 | 175% | 3.75 |
| 137m | PLUM/PLUM/PLUM | 50 | 300% | 100.0 | 300% | 100.0 |
| 137n | BAR/BELL/BELL | 4 | 200% | 4.0 | 200% | 4.0 |
| 137o | BELL/BELL/BAR | 20 | 200% | 20.0 | 200% | 20.0 |
| 137p | BELL/BELL/BELL | 20 | 300% | 40.0 | 300% | 40.0 |
| 137q | BAR/BAR/BAR | 20 | 750% | 130.0 | 1,000% | 180.0 |
| 137r | 7/7/7 | 1 | 1,000% | 9.0 | 1,500% | 14.0 |

FIG. 3A

150

| | COMBINATION 132 | EXPECTED HITS PER CYCLE 134 | PROPOR-TIONAL PAYOUT MULTIPLIER 154 | PLAYER WIN/(LOSS) 156 |
|---|---|---|---|---|
| 152a | NONWINNING COMBINATION | 8570 | 80% | (1714.0) |
| 152b | CHERRY/ANY/ANY | 680 | 130% | 204.0 |
| 152c | ANY/ANY/CHERRY | 680 | 130% | 204.0 |
| 152d | CHERRY/CHERRY/ANY | 200 | 160% | 120.0 |
| 152e | ANY/CHERRY/CHERRY | 200 | 160% | 120.0 |
| 152f | CHERRY/ANY/CHERRY | 68 | 160% | 40.8 |
| 152g | CHERRY/CHERRY/CHERRY | 20 | 300% | 40.0 |
| 152h | BAR/ORANGE/ORANGE | 42 | 175% | 31.5 |
| 152i | ORANGE/ORANGE/BAR | 6 | 175% | 4.5 |
| 152j | ORANGE/ORANGE/ORANGE | 42 | 300% | 84.0 |
| 152k | BAR/PLUM/PLUM | 20 | 175% | 15.0 |
| 152l | PLUM/PLUM/BAR | 5 | 175% | 3.75 |
| 152m | PLUM/PLUM/PLUM | 50 | 300% | 100.0 |
| 152n | BAR/BELL/BELL | 4 | 200% | 4.0 |
| 152o | BELL/BELL/BAR | 20 | 200% | 20.0 |
| 152p | BELL/BELL/BELL | 20 | 300% | 40.0 |
| 152q | BAR/BAR/BAR | 20 | 750% | 130.0 |
| 152r | 7/7/7 | 1 | 100.00 | 99.0 |

FIG. 4

160

| | COMBINATION 132 | EXPECTED HITS PER CYCLE 134 | PROPOR-TIONAL PAYOUT MULTIPLIER 164 | PLAYER WIN/(LOSS) 166 |
|---|---|---|---|---|
| 162a | NONWINNING COMBINATION | 8570 | (0.2) | (1714.0) |
| 162b | CHERRY/ANY/ANY | 680 | 130% | 204.0 |
| 162c | ANY/ANY/CHERRY | 680 | 130% | 204.0 |
| 162d | CHERRY/CHERRY/ANY | 200 | 160% | 120.0 |
| 162e | ANY/CHERRY/CHERRY | 200 | 160% | 120.0 |
| 162f | CHERRY/ANY/CHERRY | 68 | 160% | 40.8 |
| 162g | CHERRY/CHERRY/CHERRY | 20 | 300% | 40.0 |
| 162h | BAR/ORANGE/ORANGE | 42 | 175% | 31.5 |
| 162i | ORANGE/ORANGE/BAR | 6 | 175% | 4.5 |
| 162j | ORANGE/ORANGE/ORANGE | 42 | 300% | 84.0 |
| 162k | BAR/PLUM/PLUM | 20 | 175% | 15.0 |
| 162l | PLUM/PLUM/BAR | 5 | 175% | 3.75 |
| 162m | PLUM/PLUM/PLUM | 50 | 300% | 100.0 |
| 162n | BAR/BELL/BELL | 4 | 200% | 4.0 |
| 162o | BELL/BELL/BAR | 20 | 200% | 20.0 |
| 162p | BELL/BELL/BELL | 20 | 300% | 40.0 |
| 162q | BAR/BAR/BAR | 20 | 750% | 130.0 |
| 162r | 7/7/7 | 1 | 1,000% | 9.0 |

FIG. 5

APPARATUS PROVIDING PAYOUTS PROPORTIONAL TO WAGERS AND METHODS FOR OPERATING SAME

CROSS-REFERENCE TO RELATED APPLICATIONS

This application is a continuation-in-part application of commonly-owned U.S. application Ser. No. 09/782,998, entitled GAMING METHOD AND APPARATUS HAVING A PROPORTIONAL PAYOUT and filed Feb. 14, 2001, now U.S. Pat. No. 6,589,115 which is a continuation application of U.S. application Ser. No. 08/947,243, entitled GAMING METHOD AND APPARATUS HAVING A PROPORTIONAL PAYOUT and filed Oct. 8, 1997 and which issued on Apr. 10, 2001 as U.S. Pat. No. 6,213,877 B1. The entirety of each of these applications is incorporated by reference herein for all purposes.

This application is related to co-pending, commonly-owned U.S. application Ser. No. 10/361,201, which was filed on Feb. 7, 2003, and which is a continuation-in-part application of U.S. application Ser. No. 09/521,875, filed Mar. 8, 2000 and which issued as U.S. Pat. No. 6,520,856 B1 on Feb. 18, 2003. The entirety of each of these applications is incorporated by reference herein for all purposes.

The present Application is also related to U.S. patent application Ser. No. 10/793,135, entitled "SYSTEMS AND METHODS FOR EXECUTING GAMES EMPLOYING BONUS AMOUNTS BASED ON BONUS CHARACTERISTICS", filed on Mar. 3, 2004, which itself claims priority to U.S. Provisional Patent Application Ser. No. 60/452,079 filed on Mar. 4, 2003.

BACKGROUND

Slot machines generate greater than ten billion dollars per year in revenue for US casinos, with individual machines typically earning between fifty and one hundred and fifty dollars per day. Despite their popularity, however, slot machines offer players a somewhat limited selection of strategies in comparison to other casino games.

More specifically, table game players, such as blackjack players, have the opportunity to 'press' or increase their bets when they feel lucky, and to reduce their bets when they feel unlucky. No comparable option is readily available to the slot player.

While a slot player may reduce a bet by reducing the number of coins played, this option often results in his being excluded from the opportunity to win the top jackpot. In order to significantly increase his bet, a player typically would have to move to a higher denomination machine, a very undesirable option requiring him to leave his lucky, or 'hot' machine. While a player may have the option to increase the number of coins bet, the range of bets on typical machines is very limited—often from one to three coins.

Thus, it would be very desirable to provide a slot machine which offers to players the ability to press or increase their bets when they are winning. It would be further desirable to offer such a machine which enables players to limit their losses when they are losing. Such a machine could result in the increase of both the total play and the wagered amount of the players.

BRIEF DESCRIPTION OF THE DRAWINGS

The various embodiments of the present invention may be understood from a consideration of the following description, which includes a description of a plurality of figures, in which:

FIG. 2 is a table showing components of the probability table of FIG. 1;

FIG. 3 is a table showing components of one embodiment of a proportional payout table;

FIG. 3A is a table showing components of the embodiment of the proportional payout table of FIG. 1;

FIG. 4 is a table showing components of another embodiment of a proportional payout table;

FIG. 5 is a table showing components of yet another embodiment of a proportional payout table;

DETAILED DESCRIPTION

In accordance with one or more embodiments of the present invention there is provided herein a gaming method and apparatus, illustrated by way of a slot machine, having a proportional payout table used to determine payouts constituting a proportion of the amount wagered.

As used herein, the term "slot machine" means all gaming machines wherein a paid play generates a random or pseudo-random outcome used to determine a payout, including slot machines, video poker, keno, bingo, video roulette, video blackjack, etc.

Figure 1:
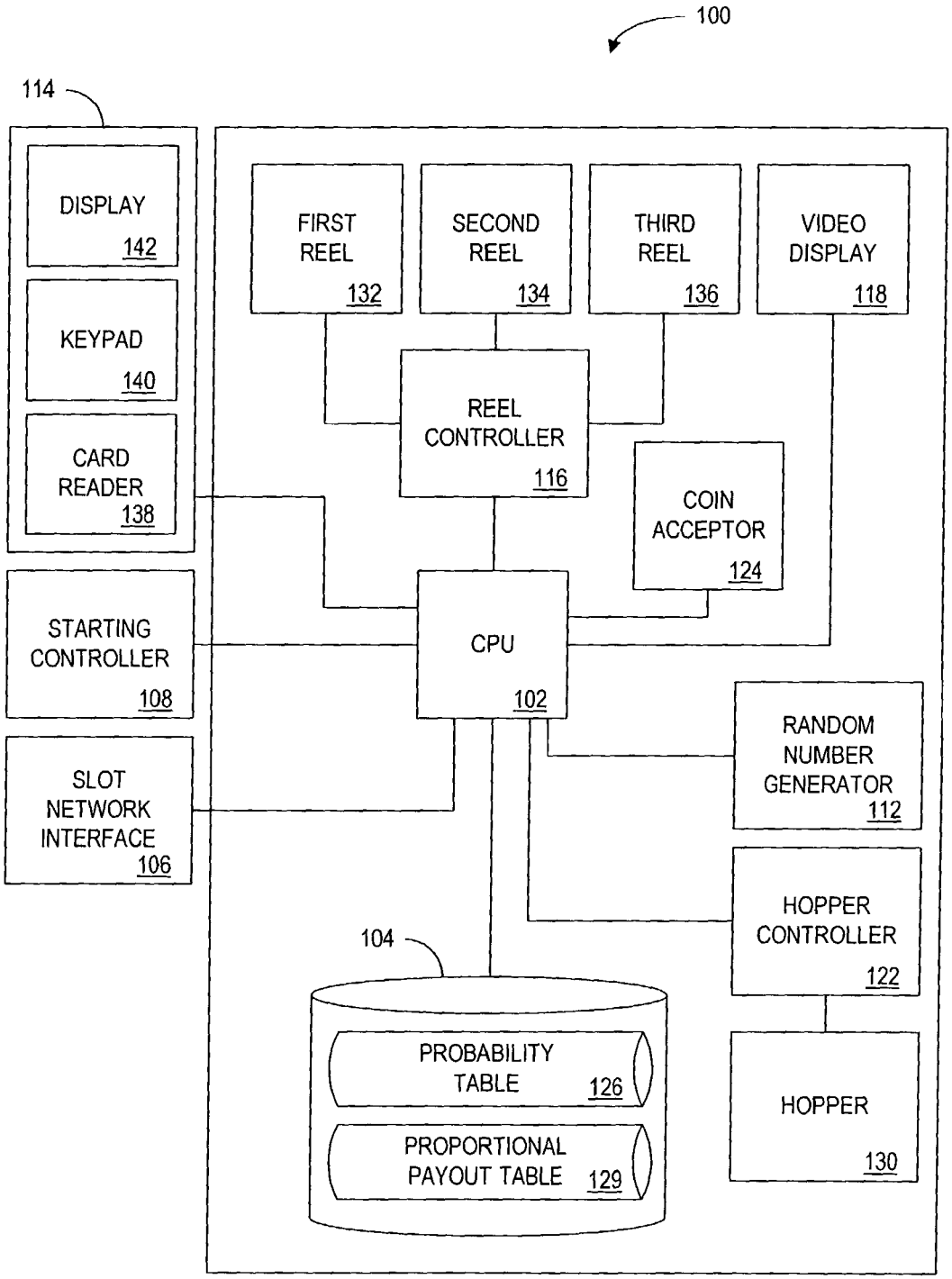
FIG. 1 is a block diagram of a slot machine constructed in accordance with one or more embodiments of the present invention.

Referring now to FIG. 1, there is shown a block diagram of a slot machine 100 including a central processing unit (CPU) 102 and a data storage device 104 connected to the CPU. Further connected to CPU 102 are: a slot network interface 106, a starting controller 108, a random number generator 112, an input/output (I/O) device 114, a reel controller 116, a video display 118, a hopper controller 122, and a coin acceptor 124.

Slot machine 100 comprises conventional components, with the exception of a proportional payout table 129 contained in storage device 104. As will be described in detail below, proportional payout table 129 functions to determine the payout of the slot machine in accordance with the present invention. For purposes of better illustrating the invention, standard components, well known to those skilled in the art, are described only briefly. Although the present embodiment of the invention is described as implemented with physical components, the invention applies equally well to and includes software embodiments such as would be implemented on the Internet and other computer data networks, or in software games simulating game play at a slot machine.

Referring again to CPU 102, the device comprises one of many well known processing units, for example a Pentium class CPU manufactured by Intel Corp. Data storage device 104 comprises an appropriate combination of magnetic and optical memory, such as disk drive memory, and semiconductor memory such as random access memory (RAM) and read only memory (ROM). In addition to proportional payout table 129, data storage device 104 stores a probability table 126 and appropriate operating system and control software (not shown), functional to operate slot machine 100 in the manner described below. Random number generator 112 comprises one of many well known random or pseudo-random number generators suitable for use in a gaming device. As will be further described below, during game play, data storage device 104 also stores a player credit balance. Because generated payouts may be in fractional form in addition to increments of whole coins, storage of a player credit balance includes decimal amounts.

Coin acceptor 124 is operative to receive one or more coins, and to transmit an appropriate value signal to CPU 102. Hopper controller 122, and hopper 130 connected thereto, are operative under the control of CPU 102 to dispense and output coins to a player. In one embodiment, all partial coin amounts are rounded to the nearest whole coin. Reel controller 116 is operative to control the spin and outcome displayed by first, second, and third reels 132, 134, 136, respectively, which may be mechanical in nature, or graphical and displayed on video display 118. In the present embodiment, slot machine 100 comprises a "22 stop" machine, such that 22 indicia are contained on each of reels 132, 134, 136. Video display 118 comprises any appropriate video display apparatus, for example, a cathode ray tube or a liquid crystal display screen.

Starting controller 108 comprises a player-operated device such as a handle or button for initiating the play of a game. I/O device 114 comprises a conventional player interface including a card reader 138 for receiving a player tracking card, a display 142 for communicating alpha/numeric messages to the player, and a keypad 140 for receiving player input such as a player identifier.

Slot network interface 106 comprises a conventional network interface for connecting slot machine 100 to a centrally controlled network consisting of multiple machines, enabling functions further described below.

Referring now to FIG. 2, probability table 126 is seen to include eighteen records indicated at 128*a-r*, each record including three fields: a random number field 130, a combination field 132, and an expected hits per cycle field ('hits' field) 134. Random number field 130 of each record indicates a range of random numbers, for example record 128*d* indicating a range of random numbers from 9931 through 10130. Combination field 132 indicates a reel indicia combination for each random number range, the combination for record 128*d* comprising "Cherry/Cherry/Any", the "Any" constituting any reel indicia other than Cherry. Thus, when random number generator 112 generates a random number in the range of 9931 through 10130 for a game play (the details of which are described below), reel controller 116 will control reels 132, 134, 136 to display the described Cherry/Cherry/Any combination. It should be noted that, although a combination described in various embodiment herein comprises a combination of symbols on a reel slot machine, a combination may comprise a combination of any symbols, characters or other indicia used in a game. For example, a combination in a video poker game may comprise a hand of cards.

Continuing with reference to FIG. 2, hits field 134 includes the theoretical number of times a particular random number range and corresponding combination will occur, out of a total of 10,648 plays in a cycle. Thus, with reference again to record 128*d*, a random number in the range of 9931 through 10130 will occur, resulting in a Cherry/Cherry/Any combination, two hundred times out of every 10,648 game plays. Each other record 128*a-r* in table 126 is interpreted in a like manner.

The selection of the data for probability table 126 is performed in a manner well known to those skilled in the art, and, as will be understood from a consideration of the further explanation below, is performed so as to yield combinations 132 and payouts that make the game enticing to the player while yielding a 'house advantage' sufficient to produce a predetermined level of profit for the operator of the slot machine. The contents of table 126 have been selected for the described embodiment of the invention from Regan, Jim, *Winning At Slot Machines*, Carol Publishing Group Edition, 1996. One skilled in the art will recognize the table as conventional for a twenty-two stop machine.

Referring now to FIG. 3, one embodiment of a proportional payout table 135 is shown to include eighteen records 136*a-r*, each of which includes seven fields: combination and expected hits per cycle fields 132, 134, which are identical to the like-numbered fields from FIG. 2, a pay amount field 138, a coins paid field 140, a fixed player win/(loss) field 142, a proportional payout multiplier field 144, and a proportional player win/(loss) field 146.

Pay Amount field 138, coins paid field 140, and fixed player win/(loss) field 142 comprise fields from a conventional prior art slot machine. They are included here for the purpose of illustrating the invention. They are not necessary to the practice of the present invention.

More particularly, pay amount field 138 indicates the number of coins paid out on a game play where a random number results in the generation of a particular combination 132. Coins paid 140 indicates the theoretical number of coins paid out over the cycle of 10,648 plays for each combination 132, while fixed player win/(loss) field 142 indicates the theoretical player win/(loss) for a given pay combination 132. Thus, examining record 136*d*, with the Cherry/Cherry/Any combination expected to occur 200 times out of a cycle of 10,648 plays, and with a pay amount of 5 coins, then 1000 coins would be paid out over the cycle. Subtracting the 200 coins wagered yields the player win of 800 coins. A slot machine paying out in accordance with pay amount field 138 would provide a house advantage of 5.5%, calculable by dividing the total player loss of 586 coins by the total coins wagered for the cycle of 10,648.

Continuing to describe FIG. 3, in lieu of using pay amount field 138 to determine a payout for a given combination, in accordance with embodiments of the present invention, proportional payout multiplier field 144 is used to determine a proportional percentage of the wagered amount to be paid for each given combination. Thus, continuing to examine record 136*d*, for the Cherry/Cherry/Any combination, a proportional payout multiplier of one-hundred and sixty percent (160%) is applied to the wagered amount. This results in a payout of 60% of the amount wagered being added to the credit balance and a final credit balance that is 160% of the amount wagered (assuming the amount wagered was the entire credit balance). For example, a player putting at risk a wager of thirty coins would receive a payout of eighteen coins, bringing his credit balance to forty-eight coins. For the non-winning combination of record 136*a*, eighty percent out of the player's credit balance will remain, resulting in a 20% loss of the amount wagered by the player.

Examining proportional player win/(loss) field 146 (which is based on a one coin wager), it can be seen that the total payouts to the players and the total house advantage using applicant's proportional payout table remain almost the same as those resulting from the use of the fixed pay amount. Thus, as will be described in further detail below, applicant's slot machine provides players with significantly improved wagering flexibility and options while providing substantially the same player payout and house advantage.

With reference now to FIG. 3A, proportional payout table 129 is shown to include eighteen records 137*a-r*, each including six fields: combination and expected hits per cycle fields 132, 134, corresponding to the like-numbered fields in FIG. 3, proportional payout multiplier field 144 and proportional player win/(loss) field 146, also corresponding to the like-numbered fields in FIG. 3, a second proportional payout multiplier field 145, and a second player win/(loss) field 147. In comparison to proportional payout table 135 of FIG. 3, the second proportional payout multiplier field 145 has been included to provide increased payouts for wagers greater than a predetermined number of coins/credits: in the embodiment described here, wagers greater than one hundred coins. Proportional player win/(loss) field 147 provides corresponding data for proportional payout multiplier field 145.

Thus for wagers of less than one hundred coins, proportional payout multiplier field 144 is used to select the appropriate proportional payout multiplier. For wagers greater than one hundred coins, a proportional payout multiplier is selected from proportional payout multiplier field 145. As will be understood from a consideration of proportional player win/(loss) field 147, the house advantage is lower for larger wagers having a proportional payout multiplier selected from field 145. Such a lower house advantage is similar to the lower house advantage accepted for slot machines of the prior art: that is, for example, machines of the prior art typically incorporate bonus payouts when maximum coins are played.

Turning now to FIG. 4, another proportional payout table 150 is shown including eighteen records 152*a-r*, each including four fields: combination and expected hits per cycle fields 132, 134, corresponding to the like-numbered fields in FIG. 3, a proportional payout multiplier field 154, and a player win/(loss) field 156. In comparison to proportional payout table 135 of FIG. 3, proportional payout multiplier field 154 has been modified in record 152*r* to reflect a maximum payout, or jackpot, of a fixed number of 100 coins. The net player profit and house advantage remain substantially the same as when the previous embodiment of the proportional payout table is utilized, thus providing players with a fixed jackpot game play option. Higher jackpot payouts can be offered where a lower house advantage is acceptable. In an alternate embodiment of the invention, the higher of either the jackpot or the proportional payout is paid to the player.

It should be noted that in embodiments in which fixed payouts are combined with proportional payouts, the house advantage varies depending on the number of coins wagered. In the present embodiment, as more coins are wagered, the house advantage increases because one of the potential payouts to the player (the jackpot for 7-7-7) remains fixed, i.e., does not increase along with the other payouts. Players may perceive a benefit in that the top payout is guaranteed to be a substantial fixed value, regardless of the number of coins wagered.

With reference now to FIG. 5, yet another proportional payout table 160 is shown including eighteen records 162*a-r*, each including four fields: combination and expected hits per cycle fields 132, 134, corresponding to the like-numbered fields in FIG. 4, a proportional payout multiplier field 164, and a player win/(loss) field 166. In comparison to proportional payout table 135 of FIG. 3, proportional payout multiplier field 164 has been modified in record 152*a* to reflect a fixed loss for each losing play. In the embodiment shown, a player will lose 0.2 coins every losing play, resulting in the loss of one (1) full coin for every five losing plays.

In alternate embodiments, the value of the fixed coin loss can be adjusted, and may be variable depending on the size of the wager. While a fraction of a coin may be an appropriate loss for wagers of up to several coins, a larger loss may be appropriate for larger wagers. For example, an adjustable scale may provide a 20 coin loss for wagers in the 100-200 coin range, and a 30 coin loss for wagers in the 200-300 coin range. As with the alternate embodiment described with respect to FIG. 4 above, the remaining proportional payouts can be adjusted such that the net player loss and house advantage remain substantially the same as that of FIG. 3, thus providing players with a fixed loss game play option.

Figure 6:
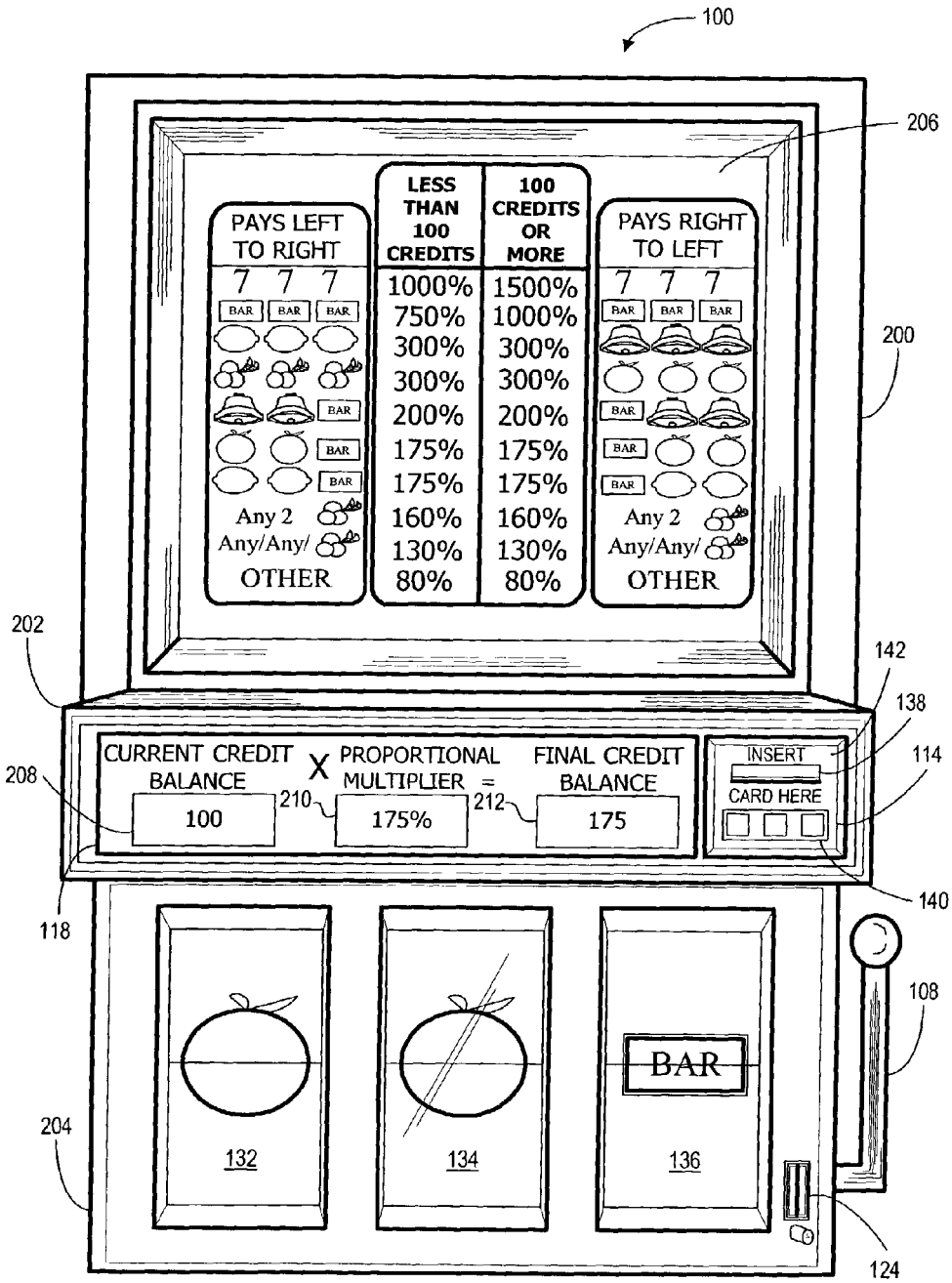
FIG. 6 is a plan view of a slot machine constructed in accordance with one or more embodiments of the present invention.

Referring now to FIG. 6, a plan view of slot machine 100 is shown which, for purposes of discussion, is generally divided into three sections: an upper panel 200, a central panel 202, and a lower panel 204. Upper panel 200 includes a pay table 206 comprising, for example, painted 'belly' glass or an updateable video screen. The details of pay table 206 are discussed with respect to FIG. 7.

Central panel 202 houses I/O device 114 including card reader 138, keypad 140, and display 142 shown set to read "INSERT CARD HERE." To the left of I/O device 114 is positioned video display area 118, the display shown as reading a CURRENT CREDIT BALANCE value 208, a PROPORTIONAL PAYOUT MULTIPLIER value 210, and a FINAL CREDIT BALANCE value 212, the details and operation of which are described below.

Lower panel 204 is seen to house coin acceptor 124, starting controller 108 (in the form of a handle), and the display of first reel 132, second reel 134, and third reel 136. In the described embodiment, the three reels constitute mechanical reels having painted indicia visible through lower panel 204. In an alternate embodiment, the reels constitute virtual electronic functions with outputs shown on conventional electronic graphical displays, such as LCD displays.

Figure 7:
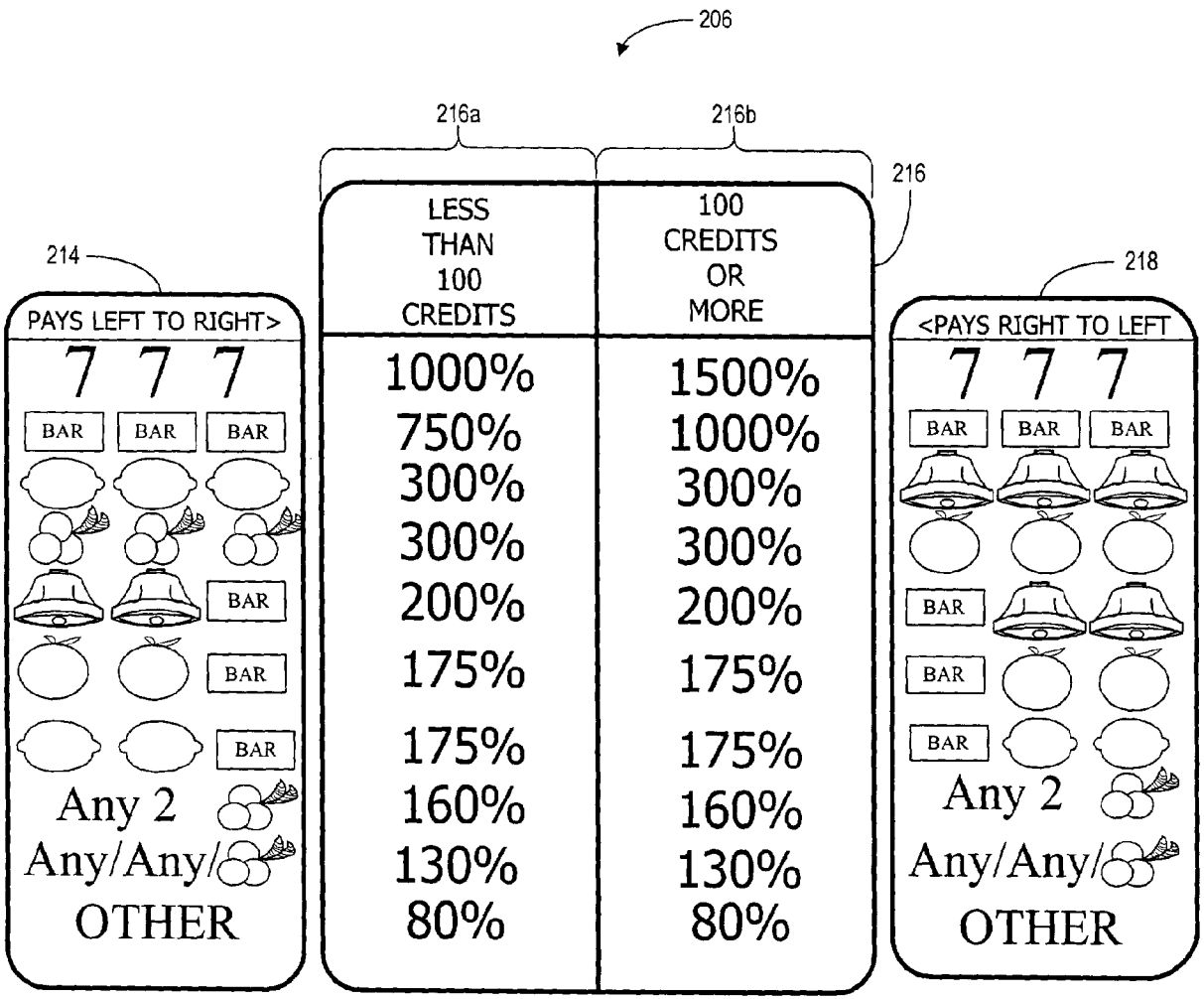
FIG. 7 is an enlarged view of the payout table of FIG. 6.

With reference now to FIGS. 6 and 7, pay table 206 is seen to include three distinct graphical areas: a first combination table 214, a proportional multiplier table 216, and a second combination table 218. Each combination table represents, in descending order of value, possible outcomes described in combination field 132 of proportional pay table 129. Multiplier table 216 represents the data stored in the proportional payout multiplier fields 144 and 145 of proportional payout table 129. That is, the proportional payout multipliers in table 216*a* correspond to field 144 of proportional payout table 129 and are available to players wagering less than one hundred coins (or credits) on a given game play. The set 216*b* of relatively higher proportional payout multipliers correspond to field 145 of proportional payout table 129 and defines awards for players wagering more than one hundred coins on a game play. As is well known to those skilled in the art, the results of a game play, indicated by the displayed indicia on first, second, and third reels 132, 134, 136, are used with the indicia in pay tables 214 and 218 to determine the outcome, or proportional payout from table 216, of a play. The outcome is determined as a result of the random number generated upon initiation of game play.

The inclusion of two sets 216*a* and 216*b* of proportional payout multipliers is intended to motivate players to place larger wagers on game plays. As described above, these two tables 216*a*, 216*b* correspond respectively to the two proportional payout multiplier fields 144, 145 of proportional payout table 145 (FIG. 3A). A player depositing two-hundred coins, for example, is eligible to have applied to his wager amount a proportional payout multiplier of 1500% for a 7/7/7 outcome, a proportional payout multiplier which is larger than the 1000% proportional payout multiplier available to a player wagering fewer than one-hundred coins. It will be appreciated that this two-tiered bonus structure is similar to that of bonuses awarded for royal flushes in video poker where maximum coins are wagered.

Figure 8:
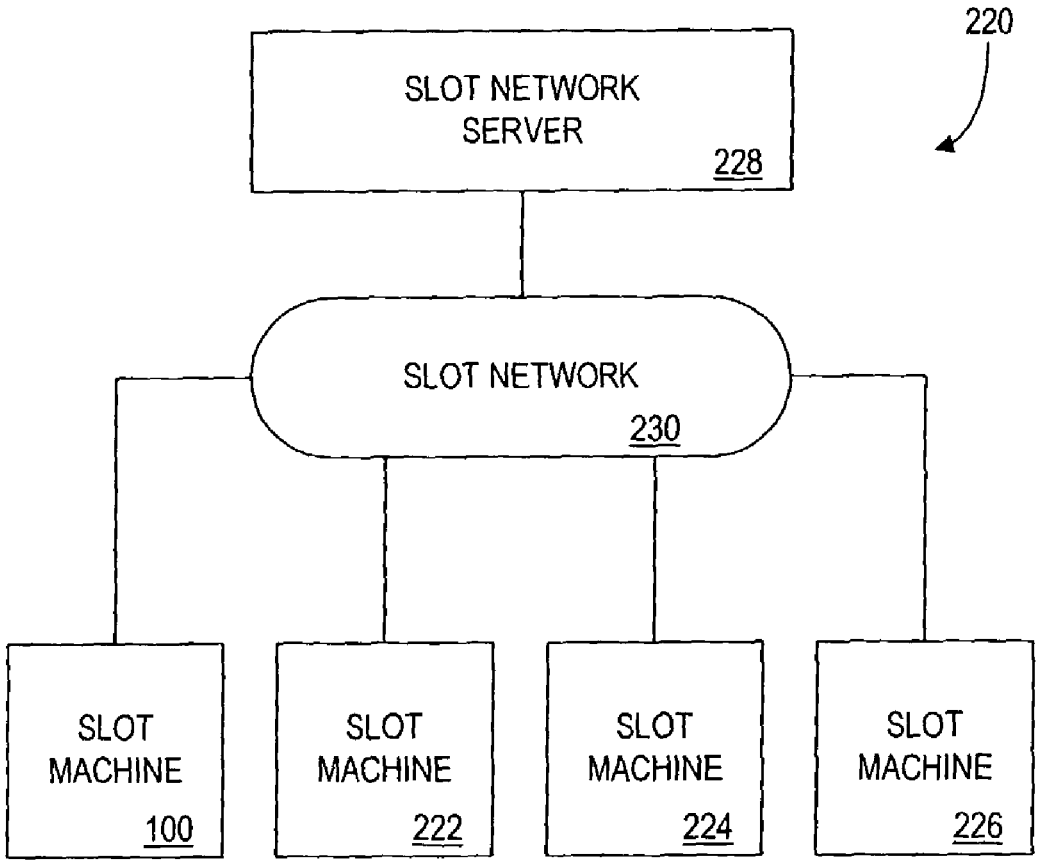
FIG. 8 is a block diagram of a network of slot machines in accordance with an embodiment of the invention.

Referring now to FIG. 8, a slot machine network 220 is shown to include four slot machines 100, 222, 224, 226 in communication with a slot network server 228 through a slot network interface 230. Slot machines 222, 224, 226 may be identical to slot machine 100, or may comprise completely different machine types, many of which are well known in the art.

Slot network server 228 can comprise one of many known servers, for example an RS/6000 manufactured by IBM Corp. Slot network interface 230 likewise comprises a well known combination of computer data links and network interface equipment. In operation, the network of slot machines enables player information to be stored on slot network server 228 and accessed at each slot machine upon the use of a player tracking or identification card in reader 138. Such central storage of information enables, for example, the storage of player credits, the storage of player-specific information, game play results such as handle pulls or coin-in, and the monitoring, control and adjustment of the various connected slot machines. Networking of slot machines has particular application in the present invention in that it enables player credit balances to be stored on and retrieved from slot network server 228. This enables a player to easily identify a large credit balance with which to wager, taking full advantage of the proportional payout feature of the machine. In one or more embodiments, slot network server 228 comprises a controller of a plurality of slot machines (e.g., a subset of all the slot machines in a particular casino).

Note that, although a proportional payout multiplier has been illustrated and described as being in the form of a percentage (e.g., eighty percent), the invention is not so limited. A proportional payout multiplier may, for example, also be in the form of a whole or fractional number (e.g., 0.80 or 1.6). Other examples of formats for a proportional payout multiplier include a squaring function, a square root function, and a function (e.g., product or sum) of two or more proportional payout multipliers.

Figure 9:
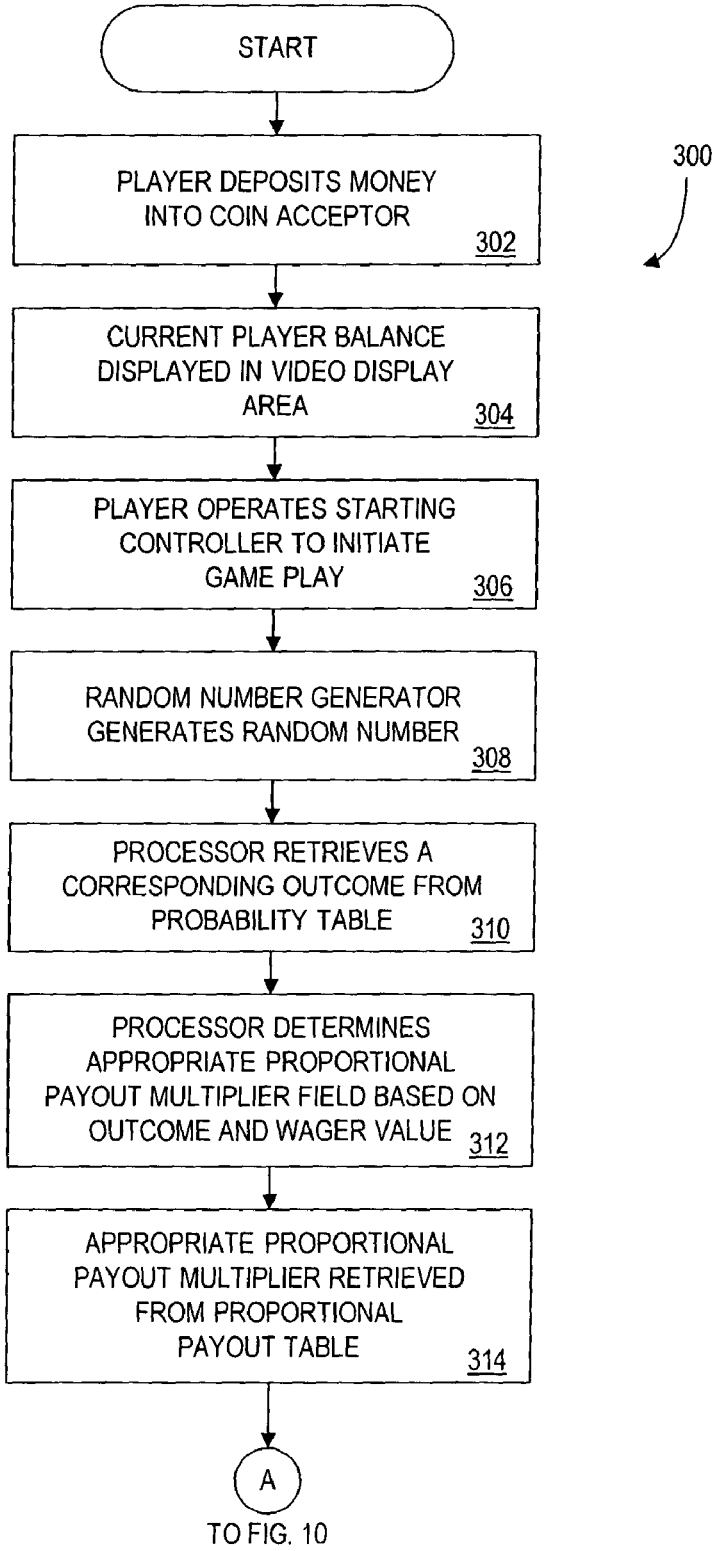
FIGS. 9 & 10 together comprise a flowchart illustrating a method of operating a slot machine in accordance with the present embodiment.
Figure 10:
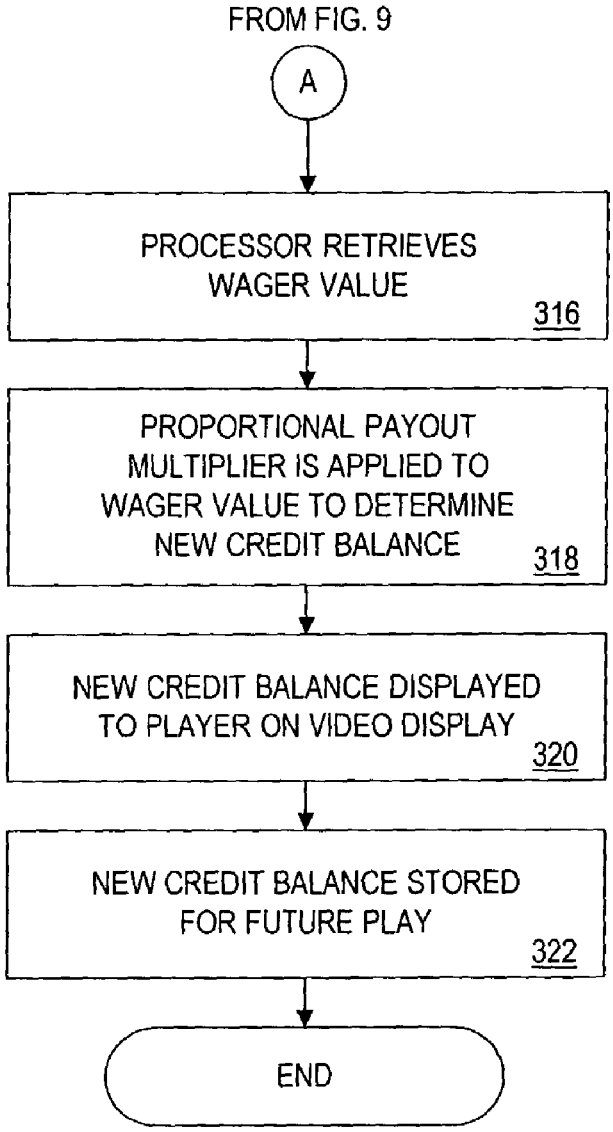

Referring now to FIGS. 9 and 10, a method 300 is shown for operating slot machine 100 in accordance with proportional payout table 129 of FIG. 3A. The operation of the machine using alternate payout tables 135 (FIG. 3), 150 (FIG. 4), or 160 (FIG. 5) is substantially identical with the substitution of the alternate proportional payouts.

To initiate a game play, a player must first establish a credit balance with the slot machine. This can be accomplished by inserting coins into coin acceptor 124 (step 302). Alternatively, the credit balance can be established by using a player tracking/identification card that either: 1) includes a credit balance encoded thereon, or 2) references a credit balance stored in slot network server 228 through slot machine network 220. In all cases, the available player balance is displayed on video display 118 (step 304).

To initiate a game play, a player further operates the starting controller of slot machine 100, in this case by pulling handle 118 (step 306). Responsive to the starting of the game play, a random number is obtained from generator 112 (step 308). It will be understood that this random number can be generated specifically for the game play, or may be selected from a series of random numbers being generated on a consistent or periodic basis by random number generator 112. Many methods of generating random numbers are well known in the art.

Subsequent to the generation of a random number for the game play, that random number is used with probability table 126 to identify the record and hence the combination corresponding to the range of the random number (step 310). For example, the random number 9998 would fall in the range designated by record 128*d*, identifying the combination Cherry/Cherry/Any. The combination along with the wager value is then used to identify the corresponding field in proportional payout table 129, in this example field 144 or 145 from record 137*d* (step 312). Hence if the wager was less than one hundred coins, then the proportional payout multiplier of 160% is selected from field 144, while if the wager was greater than one hundred coins the proportional payout multiplier (also 160%) is selected from field 145. While an identical payout results for the present example, it will be seen that different payouts would result for the winning combinations of records 137*q* and 137*r*.

CPU 102 uses the retrieved proportional payout multiplier (step 314) with the wager value signal (step 316) to calculate a new credit balance (step 318). So, for example, assuming that the credit balance showed a wager value of ninety coins, and the game play resulted in a combination of Cherry/Cherry/Any, then from record 136*d* the proportional payout multiplier of 160% is used to calculate the new credit balance as follows. Equation 1) shows the generic calculation, while equation 2) shows the actual calculation for the described example:

1) starting credit balance×proportional payout multiplier=new credit balance,
2) 90 coins×1.6=144 coins.

In the above example, the payout to the player as a result of the game play is fifty-four coins (the new balance less the wager amount is the payout amount).

Continuing with reference to FIG. 10, the new credit balance is displayed to the player on video display 118 (step 320), and stored for future play (step 322).

Alternate proportional payout tables 135, 150, and 160 may be used in lieu of table 129, with the latter two providing a maximum jackpot, and a fixed value loss, respectively. The operation of the machine would otherwise be similar to that described above.

Figure 11:
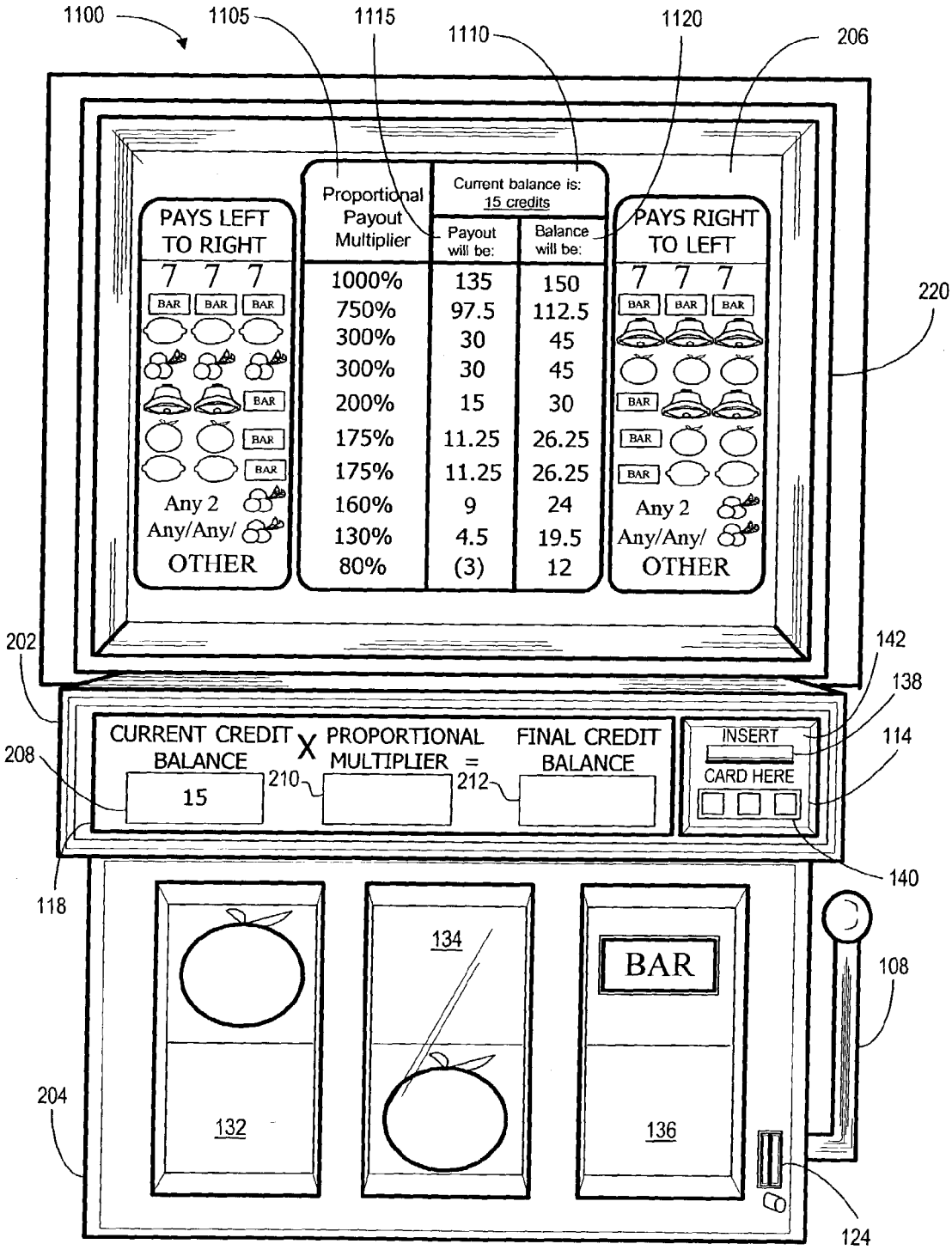
FIG. 11 is an embodiment of a front planar view of a slot machine, in accordance with one or more embodiments of the present invention.

In one or more embodiments, a payout schedule displayed on a slot machine may be updateable (e.g., each time the credit balance of the slot machine changes). The payout schedule may be updated to display, based on the current credit balance, the payout and final credit balance associated with each possible combination of symbols. FIG. 11 illustrates such an updateable payout schedule. FIG. 11 illustrates a front planar view of one embodiment 1100 of a slot machine. The embodiment 1100 may include some of the same components as described with respect to the planar view of slot machine 100 (FIG. 6). However, the payout schedule of embodiment 1100 is different from that described with respect to FIG. 6. The payout schedule of embodiment 1100 includes four fields: (i) field 1105 indicates the proportional payout multiplier corresponding to a particular combination; (ii) field 1110 indicates the current credit balance (which is also indicated in display 208); (iii) field 1115 indicates what the payout (the payment in excess of the current credit balance) will be for a particular combination, based on the current credit balance that is indicated in field 1110; and (iv) field 1120 indicates what the final credit balance will be if a particular combination is achieved for a game play.

Note that each of the entries in field 1120 is obtained by multiplying the proportional payout multiplier of a particular combination by the current credit balance indicated in field 1110. Note further that each of the entries in field 1115 is obtained by subtracting the current credit balance from the amount indicated in the corresponding entry for field 1120.

An updateable payout schedule such as that illustrated in FIG. 11 may be helpful, for example, to a player by explicitly informing the player of the amounts the player can expect to win (i.e., the payout associated with each achievable combination) or achieve as a final credit balance, without requiring the player to do the math. Note that the embodiment 1100 is illustrated as an updateable payout schedule at a point in time that is between game plays. In other words, FIG. 11 illustrates an updateable payout schedule after a game play result for a previous game play has ended (thus resulting in the current credit balance) but before a game play result for a new game play has been displayed. Note that display 210 and display 212 are not displaying any data since a result of the next game play has not yet been displayed and thus the proportional payout multiplier to be applied to the current credit balance has not yet been determined.

While several different proportional payout tables have been shown and described above, those skilled in the art will recognize that numerous different proportional payout schemes may be implemented in accordance with the present invention.

As described herein, in one or more embodiments a player may be allowed to describe his wager amount based on his credit balance. In one embodiment, for example, the player may wager his entire credit balance. In another embodiment, however, a player may be allowed to wager less than his entire credit balance yet still not be constrained (as in the prior art) to a few predetermined wager amounts. For example, a player may be allowed to indicate the portion of his credit balance that he would like to wager (e.g., one-half, one-third, one-quarter) on a game play. Note that, in such embodiments, a player still retains significant control over, and ability to customize, the amount risked on each game play since the player can control the amount of the credit balance that defines the wager. Such a function of enabling a player to wager less than the entire current credit balance could be provided by enabling CPU 10 to receive a signal indicating the value of the wager, for example from keypad 140 of I/O device 114, or from a separate, dedicated input device (not shown). As described, in this embodiment the proportional payout multiplier is applied to the wager amount, which may vary from the credit balance.

In one embodiment, a slot machine may include a plurality of mechanisms (e.g., buttons, levers, or areas of a touchscreen), each mechanism corresponding to a description of a portion of a credit balance that the player may choose to wager. For example, a slot machine may include four buttons, each button respectively corresponding to one of the following four descriptions: (i) the entire balance, (ii) one-half of the balance; (iii) one-third of the balance; and (iv) one-quarter of the balance.

In one or more embodiments, a slot machine may be operable to accept multiple wagers for a single game play, each wager defining a distinct portion of the credit balance that is to be risked on a distinct payline of the slot machine. For example, assuming a slot machine comprises two paylines "A" and "B", the slot machine may be operable to accept a wager of thirty percent of the current credit balance on payline "A" and seventy percent of the current balance on payline "B". For example, in one embodiment a slot machine may prompt a player at the initiation of each game play to indicate the portion of the credit balance the player desires to risk on each available payline. In another example, each available payline of a slot machine may be associated with a plurality of buttons or areas of a touchscreen that respectively describe a distinct portion of a credit balance. Of course, a player may elect to wager his entire current credit balance on a single payline or less than the entirety of his current credit balance on both paylines. For example, the player may wager twenty-five percent of his current credit balance on payline "A" and fifty-percent of his current credit balance on payline "B", thus leaving twenty-five percent of his current credit balance as not wagered on either payline.

In one or more embodiments, a slot machine may be configured to allow a player to indicate a desired final credit balance (e.g., the credit balance at the end of a single game play, a predefined period of time, or a predefined number of game plays). For example, when initiating a game play a player may indicate an amount to be risked on the game play (e.g., the current credit balance) and a desired final credit balance as a result of the game play. In response to such an indication, the slot machine may further be configured to adjust at least one proportional payout multiplier and/or at least one probability of a combination of symbols achievable on the slot machine. The adjustment may be performed such that, if the player risks the amount indicated, it is possible for the player to achieve the desired final credit balance based on the result of the game play.

In one or more embodiments, a slot machine may be configured to perform a bonus round such that, if the player wins the bonus round the final credit balance is a desired final credit balance indicated by the player prior to the outcome of the bonus round being revealed. For example, a player who has a current credit balance of fifty credits may indicate (e.g., by using a keyboard or keypad of the slot machine) a desired final credit balance of one-hundred credits. If the player wins the bonus round, the credit balance is set to one hundred credits. A bonus round may be won, for example, if a combination of symbols that is considered a winning combination in non-bonus game plays is displayed along a payline of the slot machine (e.g., the player is provided with the desired final credit balance rather than the payout otherwise associated with the winning outcome) or if a predefined symbol or symbols are displayed along a payline of slot machine or in another predefined display area of the slot machine.

In one embodiment, a slot machine may include a feature such as a "half-or-double" mechanism (e.g., a button, lever, or designated area of a touchscreen). Such a mechanism may allow a player (by actuating the button, lever or designated area of a touchscreen) to indicate that, for the upcoming game play or bonus round (or until the player deactivates the feature), the player is willing to risk half of his current credit balance (i.e., half of the current credit balance will be lost if the outcome of the game play or bonus round is a losing outcome) and desires to double the current credit balance if the outcome of the game play or bonus round is a winning outcome. In one embodiment, if a player chooses to enable such a feature the regular proportional payout multipliers associated with achievable combinations are overridden and the "double the credit balance" proportional payout multiplier is associated with one or more of the achievable combinations.

In one embodiment, an offer inviting a player to "half-or-double" the current credit balance may be output to the player at predetermined times. For example, such an offer may be output to a player (or such a feature may be activated) when the player indicates a desire to cash out his credit balance (e.g., by actuating the cash out button) or when the player's credit balance is a predetermined amount or within a predetermined range or has decreased by a predetermined percentage (e.g., over a predetermined period of time).

As briefly described above, when a player defines the amount the player is willing to risk on a game play or bonus round (e.g., the entire credit balance or one-half of the credit balance) and a desired final credit balance, the slot machine may be programmed to respond by adjusting one or more probabilities (each probability associated with a respective combination achievable on the slot machine) and/or one or more proportional payout multipliers (each proportional payout multiplier being associated with a respective combination achievable on the slot machine). In one embodiment, the payout schedule of the slot machine may be adjusted such that the proportional payout multiplier of one or more of the combinations is set such that, if the one or more combinations is achieved, the product of the current credit balance and the proportional payout multiplier will be the desired final credit balance.

Following is an example of how a payout schedule of a slot machine may be adjusted in response to a player's indication of a desired final credit balance. Table 1, below, is a portion of the proportional payout table 129. Specifically, Table 1 depicts, for records 137*a*, record 137*c*, record 137*d*, record 137*i*, and record 137*j*: (i) the combination field 132, (ii) the expected hits per cycle field 134, and (iii) the proportional payout field 144 for the first of table 129. Table 1 illustrates a probability (expected hits per cycle) and a proportional payout multiplier for each depicted combination, as each may be set before a player indicates a desired final credit balance.

TABLE 1

| Combination | Expected Hits Per Cycle | Proportional Payout Multiplier |
|---|---|---|
| non-winning combination | 8570 | 80% |
| any/any/cherry | 680 | 130% |
| cherry/cherry/any | 200 | 160% |
| orange/orange/bar | 6 | 175% |
| orange/orange/orange | 42 | 300% |

Assume for the present example that a player has a current credit balance of one-hundred coins and indicates a desired final credit balance of eight-hundred coins. Accordingly, a proportional payout multiplier of 800% would have to be applied to the current credit balance of one-hundred coins in order to achieve the desired final credit balance of eight-hundred coins. The proportional payout multiplier that, if applied to the amount being wagered (e.g., the entire credit balance), would result in the desired final credit balance is referred to as the desired proportional payout multiplier herein. Accordingly, the payout schedule of Table 1 may be adjusted such that one or more of the proportional payout multipliers are set-to the desired proportional payout multiplier of 800%. Table 2 illustrates the payout schedule of Table 1 after such an adjustment:

TABLE 2

| Combination | Expected Hits Per Cycle | Proportional Payout Multiplier |
|---|---|---|
| non-winning combination | 8570 | 0% |
| any/any/cherry | 680 | 0% |
| cherry/cherry/any | 200 | 0% |
| orange/orange/bar | 6 | 800% |
| orange/orange/orange | 42 | 800% |

Note that in the example set out in Table 2, two proportional payout multipliers were adjusted to be the desired proportional payout multiplier. In other embodiments, only one proportional payout multiplier (or more than two proportional payout multipliers) may be adjusted to be the desired proportional payout multiplier.

Further note that each of the remaining proportional payout multipliers (the proportional payout multipliers that were not adjusted to be the desired proportional payout multiplier) have been set to zero percent in the example illustrated in Table 2. In other embodiments, the remaining proportional payout multipliers may remain unchanged, only a subset of the remaining proportional payout multipliers may be set to zero percent, and/or some or all of the remaining proportional payout multipliers may be adjusted to be a percentage greater than zero but less than the percentage they were before the adjustment. For example, note that the House Advantage in the adjusted portion of proportional payout table 129 illustrated in Table 2 is relatively higher than in the portion illustrated in Table 1. If it is desirable to keep the House Advantage within a particular range, other proportional payout multipliers and/or probabilities may be adjusted until the House Advantage is within the desired range.

The determination of which combination's associated proportional payout multiplier is to be adjusted to be the desired proportional payout multiplier may be performed in a variety of ways. For example, in one embodiment the player may indicate one or more combinations the associated payout multiplier of which should be adjusted to be the desired proportional payout multiplier. In such an embodiment, the proportional payout multiplier of each of the one or more combinations indicated by the player may be adjusted to be the desired proportional payout multiplier. In another embodiment, a subset (e.g., one) of the combinations from the one or more combinations indicated by the player may be selected (e.g., by the slot machine or another device such as a controller of the slot machine). In other embodiments, the slot machine or other device (e.g., controller) selects the one or more combinations for which the proportional payout multiplier should be adjusted to the desired proportional payout multiplier without any input from the player regarding the combinations.

In either of the latter two embodiments, the slot machine or other gaming device may select a combination for which the proportional payout multiplier will be adjusted to be the desired proportional payout multiplier based on one or more rules. For example, the slot machine or other device may select the one or more combinations with the lowest associated probability (e.g., if the desired payout multiplier is to be greater than a predetermined amount). In another example, the slot machine or other device may select the one or more combinations the corresponding current proportional payout multiplier of which is closest to the desired proportional payout multiplier. In yet another example, the slot machine or other device may select a predetermined combination (e.g., the proportional payout multiplier of cherry/cherry/cherry is always the one that is adjusted to be the desired proportional payout multiplier).

In one or more embodiments, the expected number of hits (or probability of occurrence) for the combination for which the proportional payout multiplier was adjusted to be the desired proportional payout multiplier may also be adjusted. For example, if the proportional payout multiplier is adjusted for a combination that is relatively unlikely to be achieved (e.g., orange/orange/bar will only be achieved six times for every cycle of 10,648 plays), the probability of that combination occurring may be adjusted so that it is not as unlikely to occur. Such an adjustment of the probability would result in the adjusted payout schedule being more favorable to the player. If it is desirable to make an adjusted payout schedule more favorable to a player, such a goal may also be achieved by adjusting the proportional payout multiplier of more than one combination to be the desired proportional payout multiplier, as would be understood by one of ordinary skill in the art after reading the present description.

In any of the embodiments described herein where one or more proportional payout multipliers and/or one or more probabilities are adjusted, the adjustment may be done such that the house advantage of the slot machine is maintained at a predetermined percentage or within a predetermined percentage range. Further, the adjustments may be done in an iterative fashion. For example, different probabilities for a combination may be attempted and/or a desired proportional payout multiplier may be attempted for different combinations until the house advantage is determined to be satisfactory.

In one embodiment, if a player indicates a desired final credit balance as a result of a bonus round or game play (e.g., the player indicates what he desires the credit balance to be at then end of a winning bonus round or game play), the slot machine or another device (e.g., a controller of the slot machine) may first perform an approval process to determine whether the desired proportional payout multiplier is acceptable and/or feasible. For example, if a desired proportional payout multiplier is 10,000%, the probability of achieving a combination with such an associated proportional payout multiplier may need to be set so low (in order to maintain the house advantage within a desired level) as to make the adjustment not feasible or too unfavorable to the player.

Note that, in one or more embodiments, a player may indicate a desired proportional payout multiplier directly rather than indicating a desired final credit balance that is used to determine the desired proportional payout multiplier.

Note that the desired final credit balance may be described in a variety of ways. For example, a player may indicate a particular amount (e.g., $100.00) that the desired final credit balance is to comprise. In another example, the desired final credit balance may be described in terms of the current credit balance (e.g., double the current credit balance, 300% of the current credit balance). In yet another example, the desired credit balance may be described in terms of a product or service that the player desires to obtain (e.g., a final credit balance sufficient to purchase a dinner for two at the casino restaurant, a final credit balance sufficient to pay for a hotel room, a final credit balance sufficient to purchase a ticket to a particular show, a final credit balance sufficient to cover the player's debt with the casino, a final credit balance sufficient to earn a particular number of comp points, etc.).

In the latter embodiment, the slot machine may be operable to access a database of products or services that stores the price to the player of such products and services (or the cost of such products or services to the casino) and retrieve such a price or cost for purposes of determining the amount of the final credit balance necessary to achieve the player's objective. The slot machine may also be operable to communicate with a casino employee or another device to request an amount for the final credit balance based on the player's objective (e.g., the slot machine may page a casino employee or output a message on an output device viewable by a casino employee).

In one embodiment, a player may be presented with a menu of available products and/or services that the player may play for. For example, the player may be presented with a menu that allows a player to risk an amount (e.g., the entire current credit balance) in exchange for the opportunity to win (i) a room upgrade at the casino hotel (e.g., offered to a player who is a guest at the casino hotel); (ii) a free ticket to a show at the casino; (iii) a free dinner for two at the casino restaurant; (iv) a free facial and massage at the casino spa; or (v) 50% off an item (e.g., up to $100 in value) in the casino gift shop.

The choices displayed on such a menu may be updateable. The menu may be updated based on, for example, information about the player. Such information may be determined, for example, from the player's record in a player database (e.g., stored in the slot network server 228), which may be accessed based on the player identifier on the player tracking card that the player may have inserted into the slot machine. Such information may alternately or additionally be determined based on the player's behavior at the slot machine (e.g., current credit balance, initial credit balance, change in credit balance since the beginning of gaming session, risk aversion displayed by player in defining wagers, duration of play, etc.). In another example, the menu may be updated based on revenue management principles. For example, whether a free room upgrade is displayed as a choice may depend on how many premium rooms are available for the pertinent time period. Similarly, whether a free ticket to a show at the casino is available as a choice may depend on the rate at which tickets to the show are selling, the number of tickets currently available, and the amount of time left before the beginning of the show. For example, if there are a relatively large number of tickets left to the show at a time close to the beginning of a show and the tickets are selling at a low rate, the menu may be updated to include the choice of a free ticket to the show even if the player has a relatively low current credit balance. The perceived value of the ticket to the player may be much higher than the actual cost of the ticket (or loss resultant from not selling the ticket to a paying customer) to the casino.

The menu of choices may be updated by a casino employee (e.g., periodically or non-periodically). Alternatively, the slot machine or another device operative to communicate with the slot machine may be operable to update the menu based on one or more predetermined rules and accessible data (e.g., data about the availability of the possible products and/or services).

In yet another example of how a player may describe a desired final credit balance, a final credit balance may be described in terms of gaming activity. The gaming activity may be that of (i) the player indicating the desired final credit balance, or (ii) another player. For example, the player may indicate a final credit balance that is sufficient to allow the player to break even for the current gaming session, for the current day, or for the current visit to the casino or to allow the player to win back the twenty-dollar bill he just inserted. In such an embodiment, the slot machine may be operable to determine (e.g., based on information stored in association with the player's unique identifier) the total amount of wagers that the player has lost over the defined period (e.g., over the current gaming session, during the current day, or during the player's current visit to the casino) and set the final credit balance to be that lost amount. For example, the slot machine may communicate with another device such as a controller or server computer that stores such information.

In another example, the player may indicate information identifying another player and define the desired final credit balance in terms of that other player. For example, the player may indicate that the desired final credit balance is to be an amount greater than any individual amount won by the identified other player today. The slot machine may be operable to determine the relevant information associated with the identified other player (e.g., the largest individual amount won by the identified other player today) by communicating the player identifier and a request for the necessary information to another gaming device (e.g., another slot machine or a controller). Note that, for purposes of privacy, the relevant information associated with the identified other player, although utilized to determine the desired final credit balance, may or may not be revealed to the player describing the desired final credit balance.

In one or more embodiments, a slot machine may output to the player a predetermined number of predefined options that each describe a desired final credit balance. For example, the player may be presented with a list of possible descriptions for the final credit balance on a display device (e.g., on a screen of the slot machine such as a touch screen or another type of display device). In another example, the slot machine may include a plurality of buttons, each button describing a desired final credit balance. For example, a player may be presented with a screen that queries the player "Which amount do you want to play for? (i) thirty coins, (ii) fifty coins, (iii) one-hundred coins, or (iv) five-hundred coins?" Note that each choice may be associated in memory with a different payout schedule. In such embodiments, the player may actuate a button associated with the description the player is selecting or touch an area of a touchscreen that indicates the description the player is selecting. This selection may cause the slot machine to select the payout schedule that corresponds, in a memory of the slot machine, to the description. In other embodiments, a player may be allowed to input a customized credit balance (e.g., using a keyboard of the slot machine, the player may type in an amount or description of a product or service).

In one embodiment, a player may indicate a desired fixed payout amount that is to be valid for a plurality of game plays or bonus rounds and a fixed portion of the credit balance that is to be valid for the plurality of game play or bonus rounds. For example, the player may indicate that for the next ten game plays or bonus rounds (or until the player indicates otherwise), one-half of whatever amount happens to be the current balance at the beginning of each game play or bonus round is to be risked and that the payout for a winning result of such game play or bonus round is to be one-hundred coins. Thus, if the player wins a game play or bonus round under such a condition, one-hundred coins is added to the player's credit balance. However, if the player loses a game play or bonus round under such a condition, one-half of the player's current credit balance is taken away. It should be understood that amounts other than one-half and one-hundred coins are within the scope of the present invention.

In accordance with one or more embodiments, a slot machine may be configured such that it is inoperative to accept a wager amount that is less than the current credit balance. For example, in such an embodiment there is no need for a plurality of wager buttons that each indicate a wager amount or other means for allowing a player to indicate a wager amount. Instead, the slot machine may comprise a means for wagering, the means for wagering allowing only a wager amount that is the entirety of the credit balance, such that an amount that is less than the entire credit balance is always an unacceptable wager amount. The means for wagering may comprise a mechanism for actuating a game play (e.g., a start button, predetermined area of a touchscreen, or a handle). The means for wagering may also comprise a processor of the slot machine, operable to determine an initiation of a game play, to determine the current credit balance, and to store the amount of the credit balance in RAM as the wager amount for the game play. The processor may perform the instructions of a program stored in a memory of the slot machine to determine the wager amount each time a game play is initiated using such a mechanism, the wager amount being determined to be the current credit balance.

In one or more embodiments, a slot machine may be configured to operate in either conventional mode (where a player selects one of a predetermined number of wager amounts and a fixed payout amount is associated with each achievable combination) or proportional payout mode (where a proportional payout multiplier is associated with at least one achievable combination and the proportional payout multiplier of the combination that is a result of a game play is applied to a player-defined wager amount to determine a final credit balance). In such embodiments, when a game play is initiated on the slot machine the slot machine may first (or at least before determining the final credit balance) determine which mode a player has elected to play in and utilize one of two methods (each method respectively being associated with one of the two modes) of determining a final credit balance based on that determination. For example, a player that is feeling "lucky" or that he is on a "hot streak" may choose to play in the proportional payout mode in order to maximize his winnings, while a player that is feeling "unlucky" may choose to play in a conventional mode in order to minimize his losses and the amount risked. On the other hand, in some embodiments the proportional payout multiplier(s) even for losing combinations are each greater than zero (but less than 100%). In such embodiments, a player who feels "unlucky" may still choose to play in the proportional payout mode since his credit balance can essentially never go down to zero.

In one or more embodiments, a graph, chart, or other data may be used to inform a player of what the change in the player's credit balance would have been as a result of a game play or gaming session if the player had been playing in the proportional payout mode rather than the conventional mode of a slot machine. In one or more embodiments, such data may be presented to a player only if the outcome of the game play is a winning outcome and/or the final credit balance after the game play would have been higher if the player had been playing in proportional payout mode.

In another embodiment of the invention, the maximum jackpot for machine 100 may be progressive. That is, the jackpot increases in value for each play that a jackpot payout is not awarded. Such progressive jackpots could be applied to proportional payouts by increasing the proportion, and to fixed payouts by increasing the fixed jackpot amount. In one or more embodiments, a proportional payout multiplier associated with an achievable combination may progressively increase only if the player wins. For example, for every predetermined number (e.g., three) of game plays won by the player in a gaming session, the proportional payout multiplier may increase by a predetermined percentage (e.g., five percent).

In yet another embodiment, a minimum wager may be required in order to make a player eligible for a jackpot payout. Such a minimum wager would be displayed directly on the face of slot machine 100.

In one or more embodiments, a theme may be utilized to help visually represent the concept of a wager that is defined in terms of a current credit balance. In one example, a stock market theme may be used. For example, the player's credit balance may be presented as the player's "portfolio" and the player may be allowed to risk the entire portfolio on one game play or allowed to diversify the portfolio over a plurality of game plays. In another example, an antique market theme may be used. In yet another example, icons representing plants, trees, crops, etc. may be used to visually represent the growth (or lack of growth) of the credit balance at different rates.

Other graphics may be used to communicate the concept of a credit balance that is multiplied by a proportional payout multiplier in order to determine a final credit balance. For example, graphs (e.g., bar graphs) or charts may be used to illustrate to a player the growing or shrinking credit balance. Such a chart and/or graph may, for example, represent the percentage change in the credit balance, rather than the actual number of credits of the credit balance. Such a representation may help focus the players on the relative change in their balance rather than on the number of credits they are wagering on each game play.

In one or more embodiments, graphics may be used to indicate to a player that no game play is a losing game play. For example, a graphic of a plant that grows in length for each game play may be utilized. When the plant reaches a predetermined length (e.g., "6 feet" tall) within a predetermined number of game plays (e.g. twenty-five game plays), the player may be provided with a reward (e.g., a monetary payout, a free game play, a free drink, etc.).

In one or more embodiments, a slot machine may be operable to enable a player to "borrow" an amount of funds to be risked for a game play. For example, assume that a player has a current credit balance of twenty credits. Further assume that a payout schedule of the slot machine indicates a highest proportional payout multiplier of one-thousand percent and a lowest proportional payout multiplier of eighty-percent. If, in this example, the player were to risk the entirety of his current credit balance (twenty coins) on a game play, the most the player could lose is four credits, thus leaving the player with an ending credit balance of sixteen credits (twenty multiplied by eighty percent leaves the player with sixteen credits). Similarly, the most that the player could win is one hundred and eighty credits, leaving the player with an ending credit balance of two-hundred credits (twenty multiplied by one-thousand percent is two-hundred). However, in one or more embodiments a player may be able to "borrow" more credits to wager. In the above example, the player may be allowed to borrow up to eighty credits, giving the player a credit balance of one-hundred coins available for risking on the game play. If the player were to lose the game play, the credit balance of one-hundred coins multiplied by the eighty percent proportional payout multiplier means that the player would lose twenty credits. This would leave the player with an ending credit balance of eighty credits. Since eighty credits is what the player borrowed, this eighty credits may, at the end of the game play, be "paid back" to the casino, thus leaving the player with an ending credit balance of zero. If, on the other hand, the player were to achieve a winning outcome for the game play, the player's credit balance of one-hundred coins would be increased up to one-thousand coins (one-hundred times one thousand percent is one thousand). This highest achievable ending balance of one-thousand coins is significantly higher than the maximum two-hundred coins that the player was eligible to win if using his original twenty coin credit balance. Thus, as can be seen from the preceding example, allowing a player to borrow funds provides a method of allowing a player to risk the entirety of his credit balance even though the smallest proportional payout multiplier of the payout schedule is greater than zero, while allowing a player to significantly increase his potential winnings.

Note that the amount the player is allowed to borrow may be limited to the amount that, if the player were to obtain the combination of symbols that corresponds to the lowest proportional payout multiplier of the payout schedule, would still leave the player with sufficient funds to repay the borrowed amount at the end of the game play. A slot machine may, in one or more embodiments, be programmed to calculate this maximum amount that the player is allowed to borrow based on the player's current credit balance and the lowest proportional payout multiplier of the payout schedule. The slot machine may further be programmed to instruct the credit meter to reflect the borrowed amount and to store in RAM the borrowed amount until it is repaid.

Note that, in the description of some embodiments, a step, function, or process has been described as being performed by a slot machine. However, it is within the scope of the present invention that any and all of such steps, functions, and processes may be performed by a device other than a slot machine at which game play is occurring, in conjunction with being performed by the slot machine or in lieu of being performed by the slot machine. For example, a peripheral device associated with the slot machine, a controller of the slot machine, the slot network server 228, or another computing device may perform any and all such steps, functions, and processes.

There is thus provided a new and improved gaming device wherein, in one or more embodiments, a proportional payout based on a wager value is provided in lieu of a fixed payout amount. The invention enables players to wager large numbers of coins (i.e., to place large bets) on devices typically limited to several coins, thereby permitting the players to increase their bets when they feel lucky. Embodiments of the invention provide many different payout options, including ones where losses are proportionally limited to the wager amount. While embodiments of the invention have been shown and described with respect to a reel slot machine, the embodiments are not so limited. Embodiments of the invention are applicable to all of the types of gaming machines described above (e.g., video poker machines).

What is claimed is:

1. A gaming device comprising:

an input device;

a processor;

a display device; and a memory device which stores a plurality of instructions, which when executed by the processor, cause the processor to operate with the display device and the input device to:

(a) display a credit meter balance of zero;

(b) receive an amount of credit of a plurality of different credit amounts from a player;

(c) update the displayed credit meter balance based on the received amount of credit;

(d) in response to a request to initiate a play of a game:

(i) deduct a wager amount from the credit meter balance, the deducted wager amount being the entirety of the amount of credit displayed in the credit meter balance, wherein a wager amount that is different from the entirety of the amount of credit displayed in the credit meter balance is an unacceptable wager amount;

(ii) in response to deducting the wager amount from the credit meter balance, initiate the play of the game; and (iii) determine an outcome for the initiated play of the game;

(e) if the determined outcome is associated with an award of zero, do not add any credit to the credit meter balance; and (f) if the determined outcome is associated with an award greater than zero, update the amount of credit displayed in the credit meter balance based on said award and enable the player to request to initiate another play of the game, wherein:

(i) if the player does not request to initiate another play of the game and elects to cash-out of the gaming device, cause the amount of credit displayed in the credit meter balance to be provided to the player; and (ii) if the player requests to initiate another play of the game and does not elect to cash-out of the gaming device, repeat (d) to (f).

2. The gaming device of claim 1, wherein the memory device stores a plurality of achievable combinations of symbols, at least one of said plurality of achievable combinations of symbols corresponding to a first respective proportional payout multiplier based on a first wagered amount and said at least one of said plurality of achievable combinations of symbols corresponding to a second, different respective proportional payout multiplier based on a second, different wagered amount.

3. The gaming device of claim 2, wherein the processor includes a random number generator, and wherein the memory device further stores a respective at least one random number corresponding to each achievable combination of symbols.

4. The gaming device of claim 3, wherein when executed by the processor, the plurality of instructions cause the processor to update the amount of credit displayed in the credit meter balance in response to an initiated play of a game by:

obtaining a random number;

determining which achievable combination of symbols corresponds to the obtained random number;

determining the proportional payout multiplier based on the determined achievable combination of symbols and the amount wagered on the play of the game; and determining an award based on a product of the amount wagered on the play of the game and the determined proportional payout multiplier.

5. A computer program product, comprising a non-transitory computer readable medium having a computer readable program code embodied therein, said computer readable program code adapted to be executed by a processor of a gaming device to:

(a) cause a display device to display a credit balance of zero in an electronic credit meter balance of the gaming device;

(b) cause the display device to update the displayed electronic credit meter balance of the gaming device in response to receiving an amount of credit of a plurality of different credit amounts from a player;

(c) in response to a request to initiate a play of a game:

(i) deduct a wager amount from the electronic credit meter balance of the gaming device, the deducted wager amount being the entirety of the amount of credit displayed in the electronic credit meter balance of the gaming device, wherein a wager amount that is different than the entirety of the amount of credit displayed in the electronic credit balance of the gaming device is an unacceptable wager amount;

(ii) in response to deducting the wager amount from the electronic credit meter balance of the gaming device, initiate the play of the game; and (iii) determine an outcome for the initiated play of the game;

(d) if the determined outcome is associated with an award of zero, do not cause any credit to be added to the electronic credit meter balance; and (e) if the determined outcome is associated with an award greater than zero, cause the display device to update the amount of credit displayed in the electronic credit meter balance based on said award and enable the player to request to initiate another play of the game, wherein:

(i) if the player does not request to initiate another play of the game and elects to cash-out of the gaming device, cause the amount of credit displayed in the electronic credit meter balance to be provided to the player; and (ii) if the player requests to initiate another play of the game and does not cash-out of the gaming device, repeat (c) to (e).

* * * * *